US005165350A

United States Patent [19]

Leffel

[11] Patent Number: 5,165,350

[45] Date of Patent: Nov. 24, 1992

[54] UNDERGROUND WOOD BURNING FURNACE APPARATUS

[76] Inventor: Daniel L. Leffel, F1784 CTH.P, Stratford, Wis. 54484

[21] Appl. No.: 790,826

[22] Filed: Nov. 12, 1991

[51] Int. Cl.[5] ..... F23B 7/00

[52] U.S. Cl. ..... 110/234; 122/15

[58] Field of Search ..... 110/233, 234, 235; 122/15

[56] References Cited

U.S. PATENT DOCUMENTS 4,299,178 11/1981 Wilson ..... 110/234
4,516,534 5/1985 Jahier ..... 122/15
4,922,839 5/1990 Boucher ..... 110/234

*Primary Examiner*—Edward G. Favors
*Attorney, Agent, or Firm*—Leon Gilden

[57] ABSTRACT

A subterranean furnace construction includes a firebox, with the firebox formed with a surrounding outer wall defining a serpentine steam pipe wound therethrough for use in heating of an associated dwelling. Positioned adjacent the firebox construction is a housing inner and outer wall including an inlet and outlet pipe directed thereto for the selective directing of a heat absorbing fluid or air therewithin to provide for enhanced linear production of heat from the firebox. Associated inlet air as well as ash removal tubing is directed into the firebox construction. A fuel conveyor is optionally provided for use of the organization.

5 Claims, 4 Drawing Sheets

UNDERGROUND WOOD BURNING FURNACE APPARATUS

BACKGROUND OF THE INVENTION

1. Field of the Invention

The field of invention relates to furnace construction, and more particularly pertains to a new and improved underground wood burning furnace apparatus wherein the same is arranged for the linear direction of heat from the furnace construction.

2. Description of the Prior Art

Furnaces of various types are utilized in the prior art, however positioning of furnaces within subterranean environments require specialized equipment and the like. The instant invention attempts to overcome deficiencies of the prior art by providing a furnace construction particularly adapted to an underground environment. Prior art structure is exemplified in U.S. Pat. No. 4,577,616 to Lillo wherein a wood burning furnace is arranged positionable exteriorly to a home or trailer utilizing a large heat exchanger structure.

U.S. Pat. No. 4,724,798 to Alspaugh sets forth an outdoor wood burning furnace formed with a water jacket about the sides and top.

U.S. Pat. No. 4,926,797 to Butler sets forth a prior art wood burning furnace construction utilizing a liquid chamber with a sealed construction about the firebox structure.

As such, it may be appreciated that there continues to be a need for a new and improved underground wood burning furnace apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of furnace apparatus now present in the prior art, the present invention provides an underground wood burning furnace apparatus wherein the same is directed for the replenishment and modification of air and/or fluid directed into the surrounding jacket of the housing structure of the furnace. As such, the general purpose of the present invention, which will be described subsequently in greater detail, is to provide a new and improved underground wood burning furnace apparatus which has all the advantages of the prior art furnace apparatus and none of the disadvantages.

To attain this, the present invention provides a subterranean furnace construction including a firebox, with the firebox formed with a surrounding outer wall defining a serpentine steam pipe wound therethrough for use in heating of an associated dwelling. Positioned adjacent the firebox construction is a housing inner and outer wall including an inlet and outlet pipe directed thereto for the selective directing of a heat absorbing fluid or air therewithin to provide for enhanced linear production of heat from the firebox. Associated inlet air as well as ash removal tubing is directed into the firebox construction. A fuel conveyor is optionally provided for use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved underground wood burning furnace apparatus which has all the advantages of the prior art furnace apparatus and none of the disadvantages.

It is another object of the present invention to provide a new and improved underground wood burning furnace apparatus which may be easily and efficiently manufactured and marketed.

It is a further object of the present invention to provide a new and improved underground wood burning furnace apparatus which is of a durable and reliable construction.

An even further object of the present invention is to provide a new and improved underground wood burning furnace apparatus which is susceptible of a low cost of manufacture with regard to both materials and labor, and which accordingly is then susceptible of low prices of sale to the consuming public, thereby making such underground wood burning furnace apparatus economically available to the buying public.

Still yet another object of the present invention is to provide a new and improved underground wood burning furnace apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
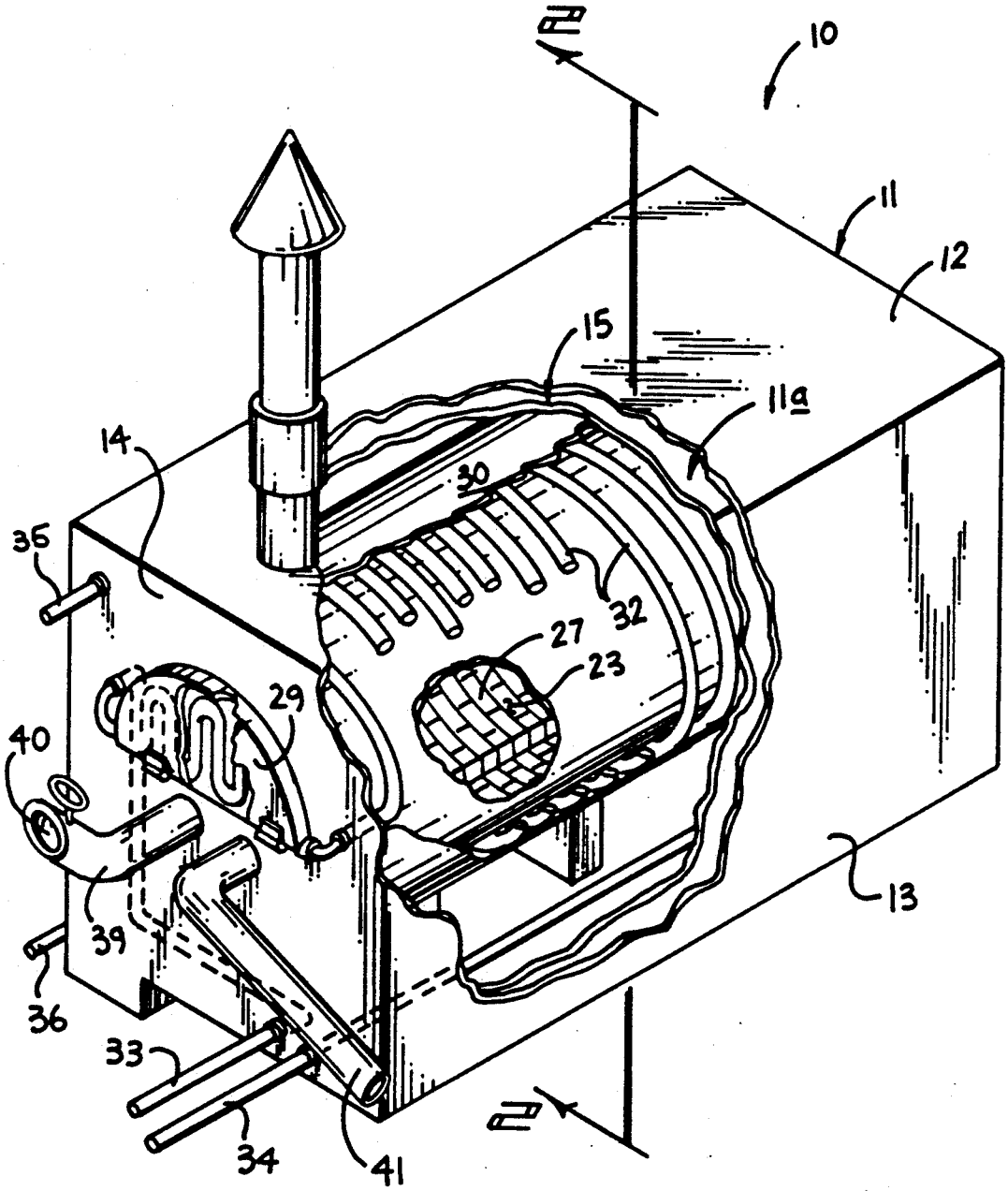
FIG. 1 is an isometric illustration of the instant invention.
Figure 2:
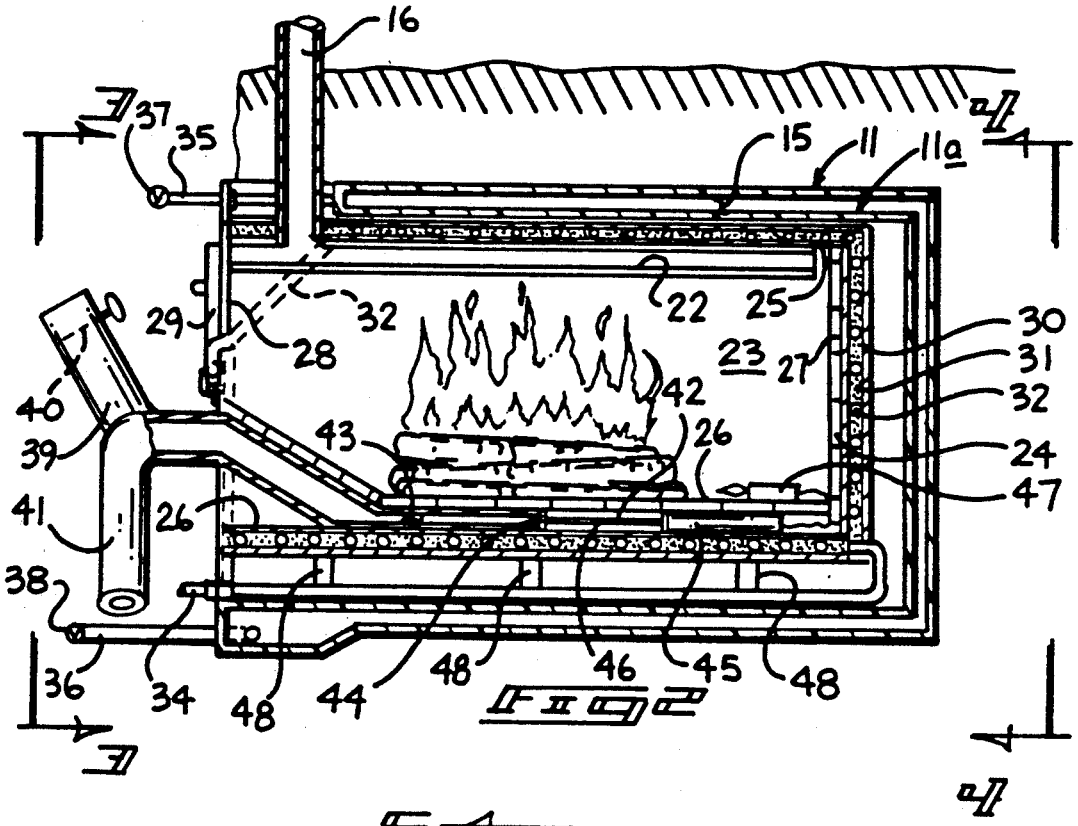
FIG. 2 is an orthographic view, taken along the lines 2—2 of FIG. 1 in the direction indicated by the arrows.
Figure 3:
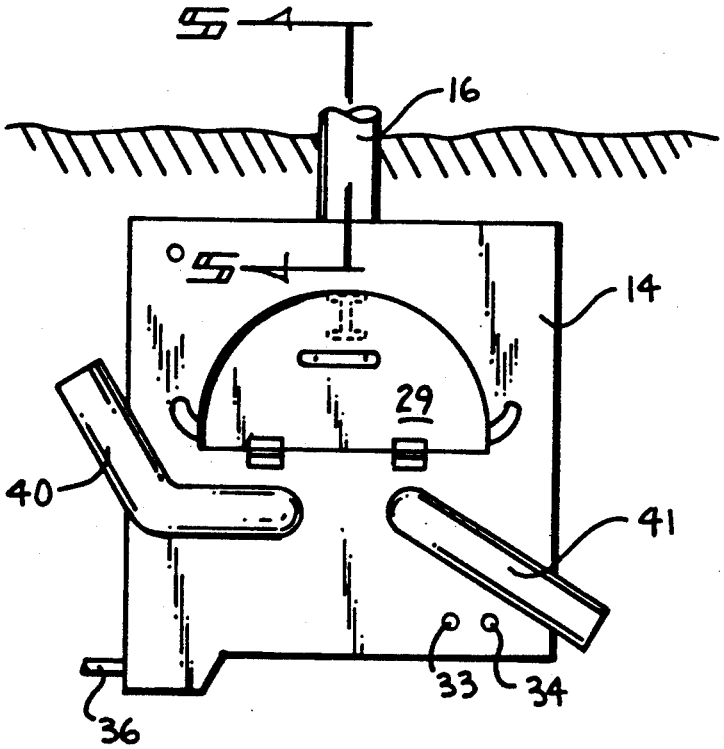
FIG. 3 is an orthographic view, taken along the lines 3—3 of FIG. 2 in the direction indicated by the arrows.
Figure 4:
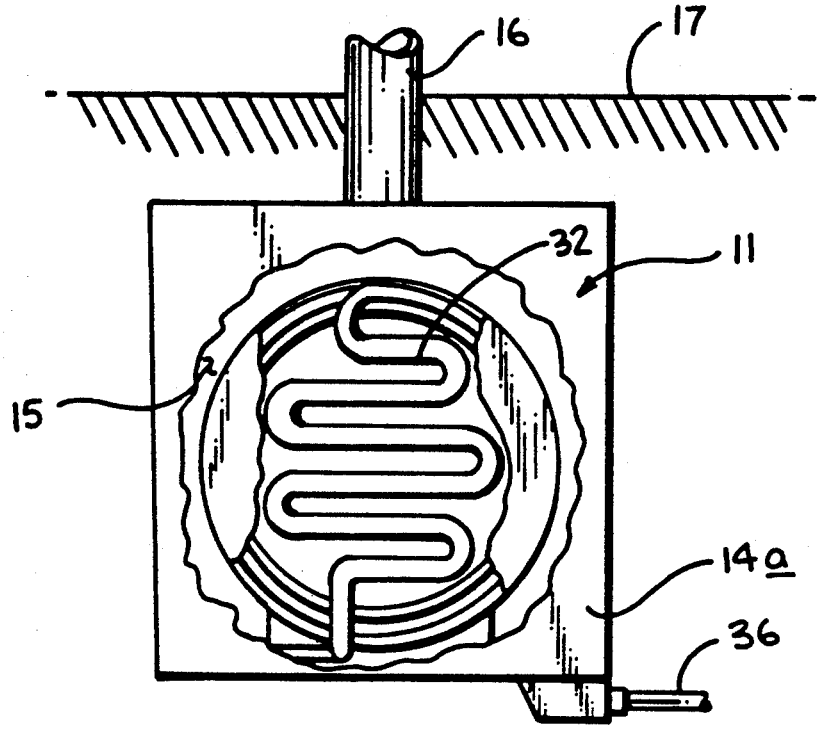
FIG. 4 is an orthographic view, partially in section, taken along the lines 4—4 of FIG. 2 in the direction indicated by the arrows.
Figure 5:
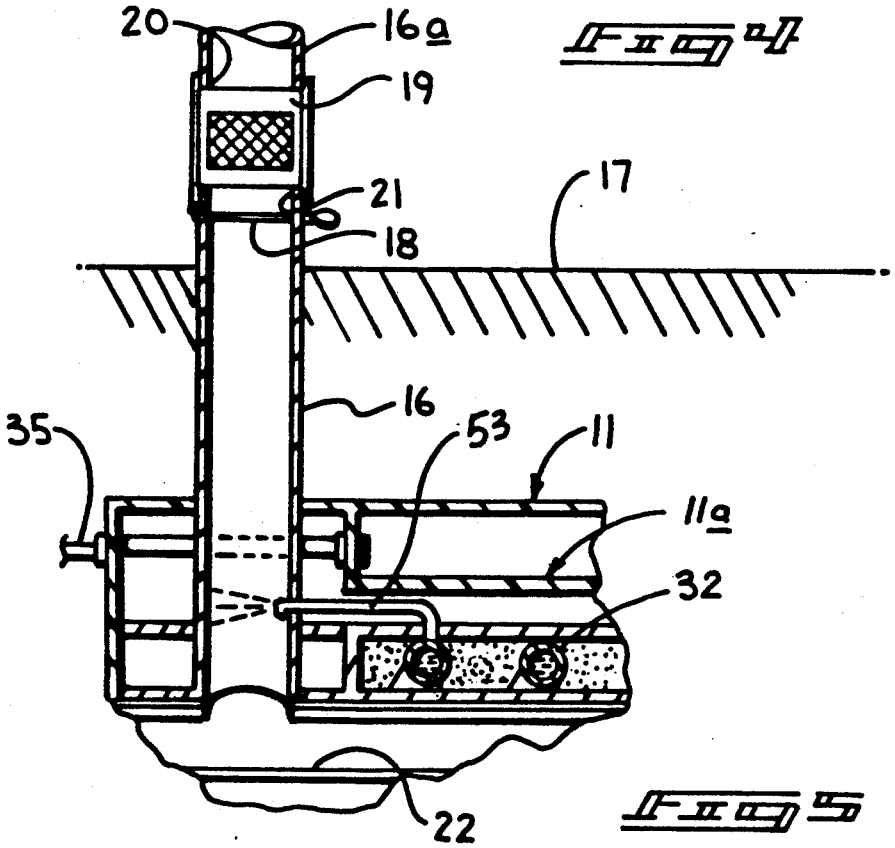
FIG. 5 is an orthographic view, taken along the lines 5—5 of FIG. 3 in the direction indicated by the arrows.

With reference now to the drawings, and in particular to FIGS. 1 to 7 thereof, a new and improved underground wood burning furnace apparatus embodying the principles and concepts of the present invention and generally designated by the reference numeral 10 will be described.

More specifically, the underground wood burning furnace apparatus 10 of the instant invention essentially comprises a housing outer wall 11 spaced from a housing inner wall 11*a*. The housing outer wall includes an outer wall top wall 12, outer wall side walls 13, outer front wall 15, and an outer wall rear wall 14*a*. It should be further noted that the outer wall 11 is also provided with a floor, and wherein each housing outer wall includes a spaced parallel cooperative inner wall defining an insulation chamber 15 coextensively therebetween. The chamber 15 includes an insulation inlet pipe 35 directed through the housing outer wall 11 adjacent the top wall, with an insulation chamber outlet pipe 36 directed through the outer wall 11 in fluid communication with the insulation chamber adjacent the floor of the housing outer wall. In this manner, it is desired that the insulation chamber 15 be afforded the introduction of fluid particularly during wintry months and thereafter drained utilizing the insulation chamber as an air chamber during summer months. It is further noted that a respective first and second valve 37 and 38 are mounted to the inlet and outlet pipes 35 and 36 respectively to control fluid and pneumatic flow into the insulation chamber 15.

Communication with the firebox 23, to be described in more detail below of the apparatus, a furnace lower flue conduit 16 is in communication therewith directed through the housing outer wall and inner wall structure to include a filter housing 19 formed with a filter housing lower socket 21 to receive an upper distal end of the furnace lower flue conduit therewithin, wherein the chimney upper flue 16*a* is received within a filter housing upper socket 20 to permit ease of dismounting of the lower and upper flue conduits 16 and 16*a* respectively in the maintenance of the filter housing 19. Positioned below the filter housing within the lower flue 16 is a flue damper 18. The elongate flue structure is arranged to project exhaust gases from the combustion or firebox 23 above the ground level 17. A flue baffle plate 22 extending from the firebox front wall 28 mounted extending from the firebox front wall 28 to a spaced relationship short of the firebox rear wall 24 is mounted to the firebox top wall 25 to direct exhaust gases from the firebox 23 between the baffle plate 22 and the firebox top wall 25 into the lower flue 16. A firebox bottom wall 26 is provided and if desired, fire brick 27 is mounted substantially coextensive with the firebox interior wall structure. The firebox bottom wall 26 provided with a bottom floor ash receiving opening 42 positioned forwardly of a reciprocatable push bar 44 that in turn is mounted to a forward distal end of a push bar piston 46 that in turn is reciprocatably contained within a push bar cylinder 45 operative through mechanical means such as hydraulics, solenoids, and the like, as desired. Fireplace ash from the firebox directed through the bottom floor opening 42 in confronting relationship with the push bar 44 is projected through an ash conduit chamber 43 positioned below the firebox floor bottom wall 26 to direct such ash through the ash conduit chamber 43 and exteriorly of the housing outer wall 11 through an ash outlet tube 41. An air inlet tube 39 directed through the front wall 14 into the firebox 23 includes a valve plate 40 to control and meter inlet air into the firebox chamber as the inlet tube 39 is positioned through the firebox adjacent the firebox bottom wall 26 to direct air to an associated wood fire within the firebox 23. The firebox front wall 28 includes a firebox access door 29 hingedly mounted to the housing front wall 14 for directing of fuel into the firebox 23. A firebox outer wall 30 is provided in a spaced relationship relative to the firebox rear wall, top wall, bottom wall, and front wall to include insulation material 31 as well as a steam pipe 32 that is wound about the firebox 23 between the firebox inner wall structure and the firebox outer wall 30. A steam pipe inlet 33 and a steam pipe outlet 34 direct the steam for recirculation in a wound relationship about the firebox to provide for heating of water within the steam pipe 32 for subsequent use in the heating of an associated dwelling.

An igniter housing 47 utilizing an electronic igniter is provided to provide for automatic ignition of materials contained within the firebox structure 23 and is mounted adjacent the firebox floor. Firebox support bars 48 arranged in a parallel relationship support the firebox outer wall 30 in the spaced relationship as illustrated relative to the firebox outer wall 30 and the housing inner wall 11*a*. The organization is further provided with an ash spray tube 53 (see FIG. 5) that projects into the lower flue 16 in fluid communication with the steam pipe 32 to meter a portion of the steam into the lower flue for the use of ash directed into the filter housing 19 and through the upper flue conduit 16*a*.

Figure 6:
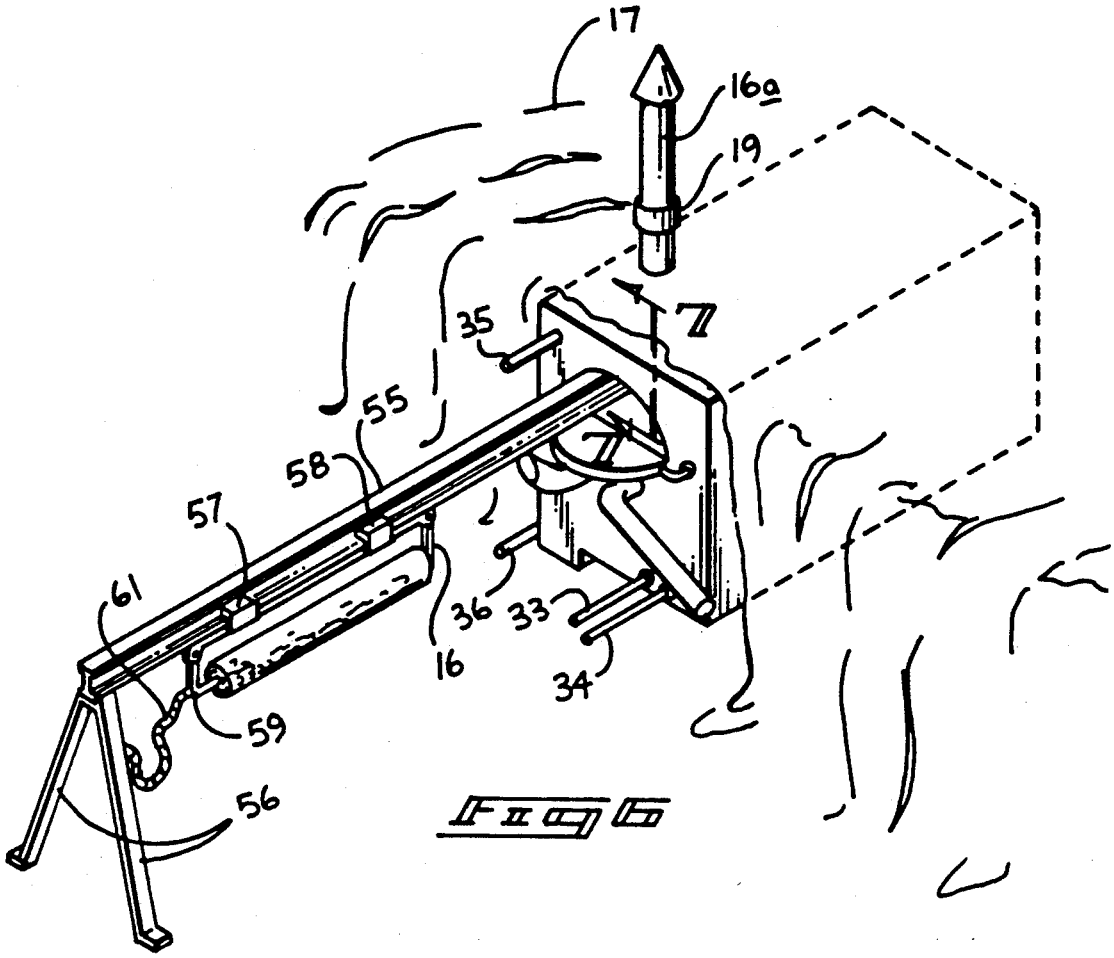
FIG. 6 is an isometric illustration of the invention illustrating a fuel conveyor associated therewith.
Figure 7:
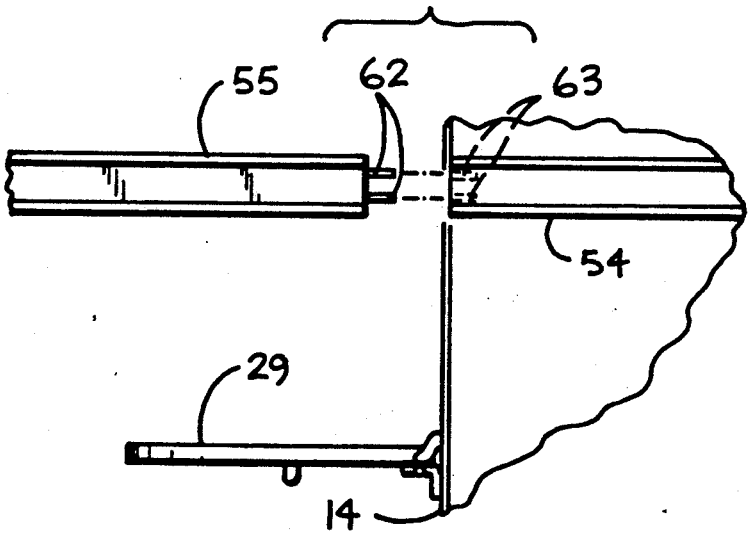
FIG. 7 is an orthographic side view of the conveyor forward portion selectively secured to the conveyor rear portion.

Reference to the FIGS. 6 and 7 illustrate the use of a first conveyor track 54 contained within the firebox in adjacency relative to the baffle plate 22 selectively securable to a second conveyor track 55 that includes mounting lugs 62 (see FIG. 7) receivable within mounting lug sockets 63 to secure the first and second conveyor track 54 and 55 together. The second conveyor track 55 includes support legs 56 mounted to a rear distal end of the second conveyor track 55 spaced from the housing front wall 14 to maintain the track in a spaced relationship to direct fuel supported by spaced first and second "L" shaped transport legs 59 and 60 that in turn are pivotally mounted to respective first and second track runners 57 and 58 slidably mounted to the first and second conveyor tracks 54 and 55. A release tether line 61 defined by a predetermined length substantially equal to a spacing from the firebox 23 to the support legs 56 is mounted to the first "L" shaped transport leg 59 at a forward distal end of the tether line and at a rear distal end of the tether line mounted to the support legs 56 and the like or to the rear distal end of the conveyor track to remove the "L" shaped transport leg 59 from the workpiece permitting its descent into the firebox 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An underground wood burning furnace apparatus arranged for positioning within a subterranean environment, including a housing outer wall, the housing outer wall spaced from a housing inner wall, and the housing inner wall including a front wall, with the front wall including a firebox access door, and a firebox contained in the housing inner wall, with the firebox access door providing access to the firebox, and the housing outer wall and the housing inner wall defining an insulation chamber defined therebetween, and the insulation chamber including an insulation chamber inlet pipe directed through the housing outer wall into the insulation chamber adjacent an upper end of the housing outer wall front wall, and an insulation chamber outlet pipe directed through the housing outer wall and in fluid communication with the insulation chamber adjacent a lower end of the housing outer wall front wall, and a first valve mounted to the insulation chamber inlet pipe and a second valve mounted to the insulation chamber outlet pipe to direct fluid flow into the insulation chamber and permit selective draining of the insulation chamber for utilization of the insulation chamber as a fluid chamber or pneumatic chamber selectively.

2. An apparatus as set forth in claim 1 wherein the firebox includes a firebox rear wall, a firebox top wall, a firebox bottom wall, and the firebox including a flue baffle plate extending from the firebox rear wall in a spaced relationship therefrom and mounted adjacent the firebox top wall extending to the firebox front wall, and a furnace lower flue directed through the housing outer wall and the housing inner wall in communication with the firebox directed through the firebox top wall adjacent the flue baffle plate; and a filter housing, the filter housing including a lower socket receiving an upper distal end of the furnace lower flue, and the filter housing including an upper socket, and a chimney upper flue conduit received within the upper socket permitting selective removal of the upper flue conduit relative to the filter housing and removal of the filter housing relative to the furnace lower flue for maintenance of the filter housing.

3. An apparatus as set forth in claim 2 wherein the firebox includes a firebox outer wall spaced from the firebox, wherein the firebox outer wall and the firebox include a steam pipe wound therebetween, wherein the steam pipe includes a steam pipe inlet and a steam pipe outlet, each directed through the housing outer wall for circulation of heated steam through the steam pipe.

4. An apparatus as set forth in claim 3 including an air inlet tube directed through the housing front wall into the firebox, the air inlet tube including a valve plate pivotally mounted within the air inlet tube to meter air flow through the inlet tube into the firebox.

5. An apparatus as set forth in claim 4 wherein the firebox bottom wall includes a bottom wall ash receiving opening directed through the firebox and the firebox outer wall in communication with an ash conduit chamber positioned between the firebox outer wall and the housing inner wall, the ash conduit chamber in communication with an ash outlet tube directed through the housing front wall, and a push bar mounted reciprocatably within the ash conduit chamber adjacent a rear edge of the ash conduit chamber in a first position and the push bar projected beyond a forward end of the ash conduit chamber in a second position, the push bar mounted to a forward distal end of a piston, and drive means to reciprocate the piston from the first position to the second position.

* * * * *